US008496043B2

(12) United States Patent
Buser

(10) Patent No.: US 8,496,043 B2
(45) Date of Patent: Jul. 30, 2013

(54) BLIND SLAT

(75) Inventor: Franz Buser, Buckten (CH)

(73) Assignee: Liftmaster Electronics Pty Ltd, Alexandria, NSW (AU)

( * ) Notice: Subject to any disclaimer, the term of this patent is extended or adjusted under 35 U.S.C. 154(b) by 364 days.

(21) Appl. No.: 12/792,348

(22) Filed: Jun. 2, 2010

(65) Prior Publication Data

US 2010/0314053 A1 Dec. 16, 2010

(30) Foreign Application Priority Data

Jun. 10, 2009 (AU) ..... 2009100562

(51) Int. Cl.
*E06B 9/00* (2006.01)
*E06B 7/08* (2006.01)

(52) U.S. Cl.
USPC ..... 160/236; 49/92.1

(58) Field of Classification Search
USPC ..... 160/236, 173 R, 173 V, 900, 168.1 R, 160/168.1 V, 178.1 R, 176.1 R, 177 R; 49/92.1, 49/74.1, 403
See application file for complete search history.

(56) References Cited

U.S. PATENT DOCUMENTS 1,632,219 A * 6/1927 Deller ..... 160/235
2,146,816 A * 2/1939 Grassby, Jr. ..... 160/178.1 R
2,603,286 A * 7/1952 Miao ..... 160/178.1 R
3,012,318 A * 12/1961 Nelson ..... 72/47
3,916,973 A * 11/1975 Schuppler et al. ..... 160/178.3
3,971,427 A * 7/1976 Coldewey et al. ..... 160/168.1 R
4,155,395 A * 5/1979 Frei ..... 160/168.1 R
4,236,566 A * 12/1980 Hensel ..... 160/130
4,343,171 A * 8/1982 Kagawa ..... 72/181
4,664,169 A * 5/1987 Osaka et al. ..... 160/107
5,165,459 A * 11/1992 Gaber et al. ..... 160/168.1 R
5,409,050 A * 4/1995 Hong ..... 160/168.1 R
5,918,657 A * 7/1999 Tuzmen ..... 160/168.1 R
6,240,998 B1 * 6/2001 Miwa ..... 160/168.1 V
6,318,441 B1 * 11/2001 Love et al. ..... 160/236
6,371,193 B1 * 4/2002 Goodman ..... 160/236
7,654,301 B2 * 2/2010 Krab et al. ..... 160/171
8,365,801 B1 * 2/2013 Motosko et al. ..... 160/235
2001/0019451 A1 * 9/2001 Digert et al. ..... 359/596
2005/0150614 A1 * 7/2005 Nien et al. ..... 160/236
2006/0225849 A1 * 10/2006 Krab et al. ..... 160/236
2010/0314053 A1 * 12/2010 Buser ..... 160/178.1 R

* cited by examiner

*Primary Examiner* — Blair M Johnson
*Assistant Examiner* — Jamie F Cardenas-Garcia
(74) *Attorney, Agent, or Firm* — The Webb Law Firm

(57) ABSTRACT

A blind slat (1) has a substantially constant cross-sectional profile extending between a leading end (2) and a trailing end (3). The profile defines an upper face (4) of the slat (1). The upper face (4) has a convex portion (6) extending from adjacent the leading end (2) towards the trailing end (3). The convex portion (6) has an apex (7) at which the upper face (4) is parallel to a reference axis (R) of the profile that extends laterally between the leading end (2) and the trailing end (3). The upper face (4) also has a concave portion (8) located between the convex portion (6) and the trailing end (3). The concave portion (8) has a base (9) at which the upper face (4) is parallel to the reference axis (R). An inflection (10) joins the convex portion (6) and the concave portion (8). The upper face (4) is inclined with respect to the reference axis (R) by at least 11° at the inflection (10). The profile has a depth measured between the leading end (2) and the trailing end (3) of between 105 and 150 mm.

6 Claims, 3 Drawing Sheets

Figure 5
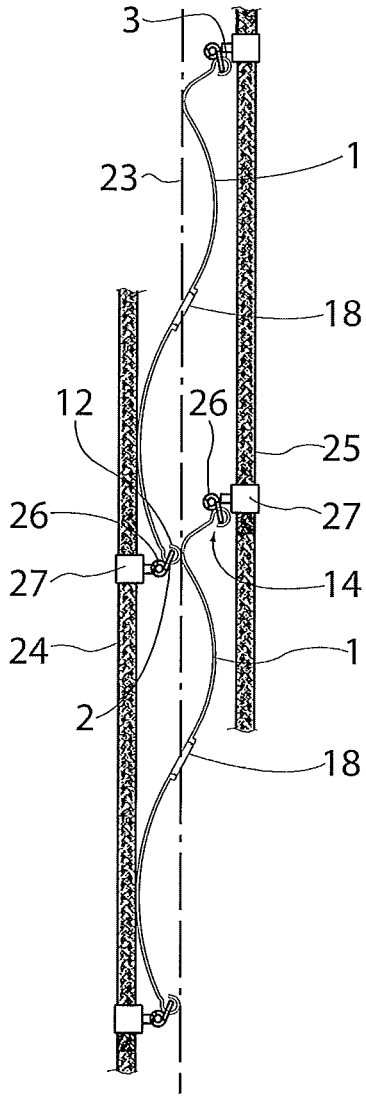
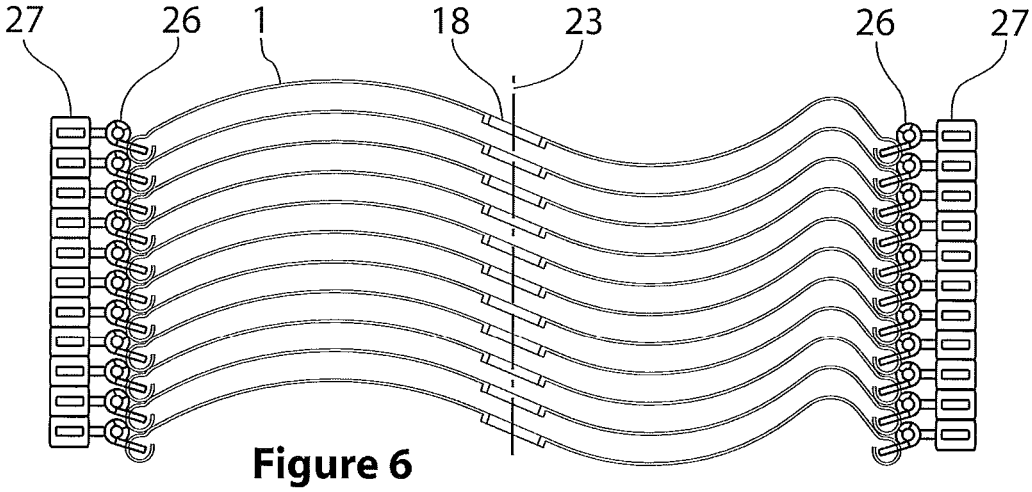
Figure 6

BLIND SLAT

TECHNICAL FIELD

The present invention relates to the field of window blinds, and in particular relates to a blind slat particularly suitable for exterior applications.

BACKGROUND OF THE INVENTION

Various forms of slat type window blinds are known, wherein a blind assembly is formed of a series of parallel horizontally extending blind slats which are suspended to across a window opening. One form of slatted blind, known as a venetian blind, typically comprises blind slats of a simple curved cross-section for interior use, being located immediately adjacent to a window on the interior side. Such blinds are not generally exposed to any significant loads, and hence are quite simple and low weight in nature. Slatted blind systems are also utilised on the exterior of buildings, located immediately adjacent the window on the exterior side. Such exterior slatted blind systems may be subject to significant wind loads, and hence structural considerations that do not affect interior blind systems must be contemplated in any blind slat design. Slatted blind systems are intended to allow for natural light to enter through the window when the blind is in the lowered and open configuration in which the individual blind slats are spaced. Energy usage from powered light sources can be reduced if the blind is able to adequately reflect light from the individual slats and project that reflected light onto work surfaces located a distance away from the window covered by the blind. Typical available slatted blind systems for exterior applications either provide inadequate light projection and/or suffer from structural deficiencies in high wind applications.

OBJECT OF THE INVENTION

It is the object of the present invention to substantially overcome or at least ameliorate one or more of the above disadvantages.

SUMMARY OF THE INVENTION

The present invention provides a blind slat having a substantially constant cross-sectional profile extending between a leading end and a trailing end, said profile defining an upper face of said slat having:

a convex portion extending from adjacent said leading end towards said trailing end, said convex portion having an apex at which said upper face is parallel to a reference axis of said profile extending laterally between said leading end and said trailing end;

a concave portion located between said convex portion and said trailing end, said concave portion having a base at which said upper face is parallel to said reference axis; and an inflection joining said convex portion and said concave portion, said upper face being inclined with respect to said reference axis by at least 11° at said inflection;

wherein said profile has a depth measured between said leading end and said trailing end of between 105 and 150 mm.

Typically, said base is offset laterally from said apex by at least 43 mm.

In one form, said convex portion has a substantially constant radius of between 50 and 65 mm.

In one form, said concave portion has a substantially constant radius of between 34 and 42 mm.

Typically, said upper face is inclined with respect to said reference axis by at least 20°.

In a preferred form, said base is laterally offset from said apex by about 49 mm and said depth is about 120 mm.

BRIEF DESCRIPTION OF THE DRAWINGS

A preferred embodiment of the present invention will now be described, by way of an example only, with reference to the accompanying drawings wherein:

FIG. 5 is a fragmentary side elevation view of an assembly of blind slats of FIG. 1 in a lowered and closed position; and FIG. 6 is a side elevation view of the assembly of blind slats of FIG. 5 in a raised and horizontal position.

DETAILED DESCRIPTION OF THE PREFERRED EMBODIMENTS

Figure 1:
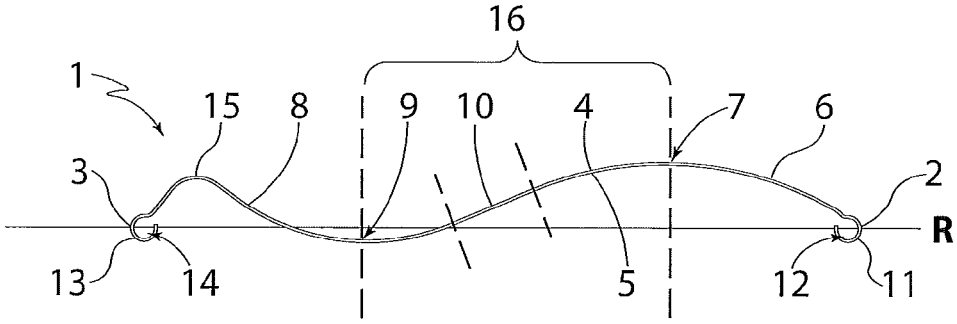
FIG. 1 is a side elevation view of a blind slat.

Referring firstly to FIG. 1, a blind slat 1 is depicted. The blind slat 1 is typically formed from sheet metal material, particularly an aluminium alloy. One suitable aluminium alloy is EN AW-3005-H47.

The blind slat 1 has a substantially constant cross-sectional profile that extends between a leading end 2 and a trailing end 3 of the profile. The profile defines an upper face 4 and a lower face 5 of the blind slat 1. The upper face 4 has a leading convex portion 6 that extends from adjacent the leading end 2 towards the trailing end 3. The convex portion 6 has an apex 7 at which the upper face 4 is parallel to a reference axis R of the profile that extends laterally between the leading end 2 and trailing end 3. The upper face 4 also has a concave portion 8 located between the convex portion 6 and the trailing end 3. The concave portion 8 has a base 9 at which the upper face 4 is parallel to the reference axis R. An inflection 10 joins the convex portion 4 and the concave portion 8. In the embodiment depicted, the inflection 10 forms a straight portion of the upper is surface 4, extending over a length of about 14 mm. It is also envisaged that the inflection may be in the form of an inflection point, whereby the convex portion 4 is directly joined to the concave portion 8 without any intervening straight portion.

Between the convex portion 4 and the leading end 2, there is a leading rolled portion 11 defining an open substantially cylindrical cavity 12 for receipt of a leading tape clip as will be discussed further below. Similarly, between the concave portion 8 and the trailing end 3 there is a trailing rolled portion 13 defining another substantially cylindrical cavity 14 for receipt of a trailing tape clip. A secondary convex portion 15 of the upper face 4 is defined between the concave portion 8 and the trailing rolled portion 13.

The profile has a depth, measured between the leading end 2 and the trailing end 3, of between 105 and 150 mm and most typically about 120 mm. The present inventor has found that the profile depth having this range, as compared to an equivalent smaller profile, performs significantly better in high wind areas, particularly insofar as structural stability is concerned.

The upper face 4 is inclined with respect to the reference axis R at the inflection 10 by at least 11° and more typically by at least 20°. In the embodiment depicted, the upper face 4 is inclined with respect to the reference axis R by approximately 23° at the inflection 10.

All points in a mid-region 16 of the upper face 4 defined between the apex 7 and the base 9 are inclined with respect to the reference axis R in the same direction, with the upper face 4 angled towards the trailing end 3. Accordingly, when the blind slat 1 is installed on the exterior side of a window with the trailing end 3 adjacent the window and leading end 2 away from the window, with the reference axis R horizontal, the mid-region 16 of the upper face 4 is inclined back towards the window. It is this mid-region 16 of the upper face 4 that generally provides diffuse light within a room bounded by the window at extended distances from the window, as will be discussed further below. The mid-region 16 should thus be as long as possible for a given profile depth, subject to structural and wind stability constraints. It is thus preferred that the base 9 is offset from the apex 7 by at least 43 mm. In the particular embodiment depicted, the base 9 is laterally offset from the apex 7 by a distance of about 49 mm.

The convex portion 6 preferably has a substantially constant radius of between 50 and 65 mm, in the embodiment depicted, the convex portion 4 has a radius of approximately 58 mm. It is also preferred that the concave portion 8 has a substantially constant radius of between 34 and 42 mm. In the embodiment depicted, the concave portion 8 has a constant radius of approximately 38 mm.

Figure 2:
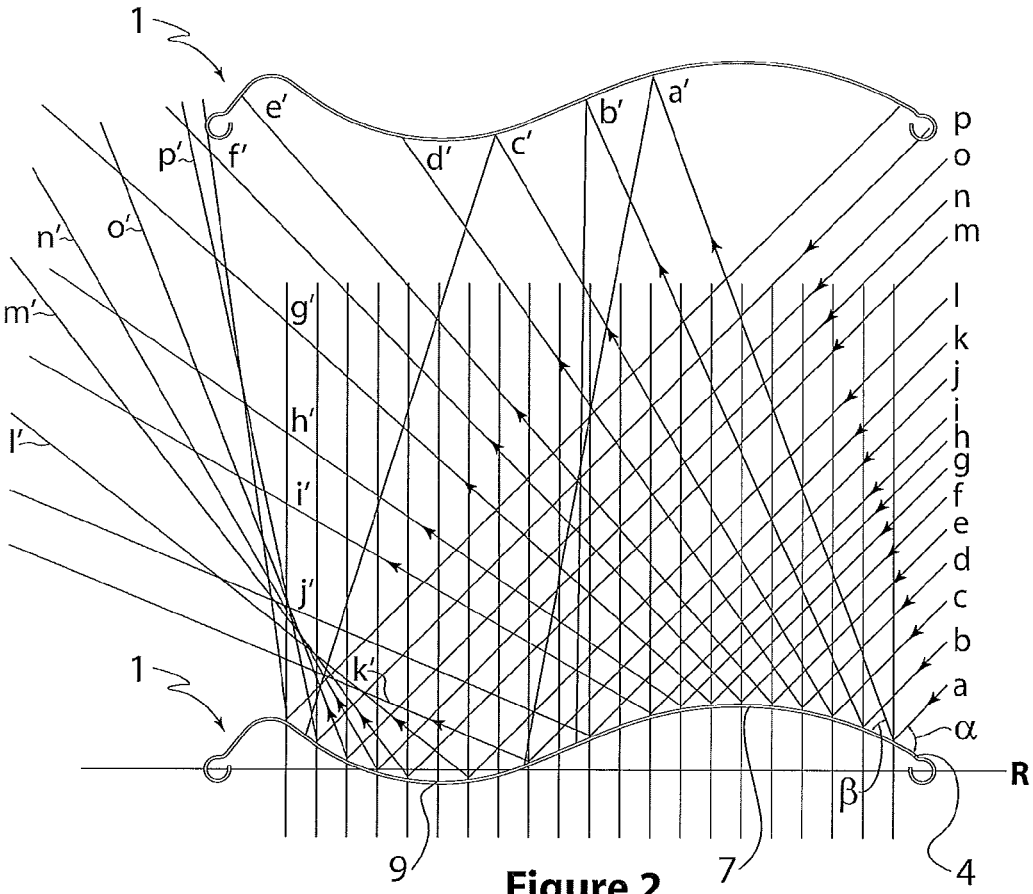
FIG. 2 is a side elevation view of a pair of the blind slats of FIG. 1 in situ depicting light reflection therefrom.

FIG. 2 depicts a pair of vertically spaced blind slats 1 as they would typically be located in situ when a blind assembly formed of the blind slats 1 is in a lowered and fully open position, with the reference axis R of each blind slat 1 oriented horizontally. A series of solar rays a-p of light impacting the upper face 4 of the lower blind slat 1 is depicted. The solar rays a-p are inclined with respect to the horizontal reference axis R by 45°, corresponding to the sun being located at a position 45° from the horizon. The solar rays a-p each impact the upper surface 4 and are reflected as reflection rays a'-p'. The angle of incidence $\alpha$ between each solar ray and the upper surface 4 at the point of impact is equal to the angle of reflection $\beta$ between the reflection ray and the upper surface 4 at the point of impact.

Figure 3:
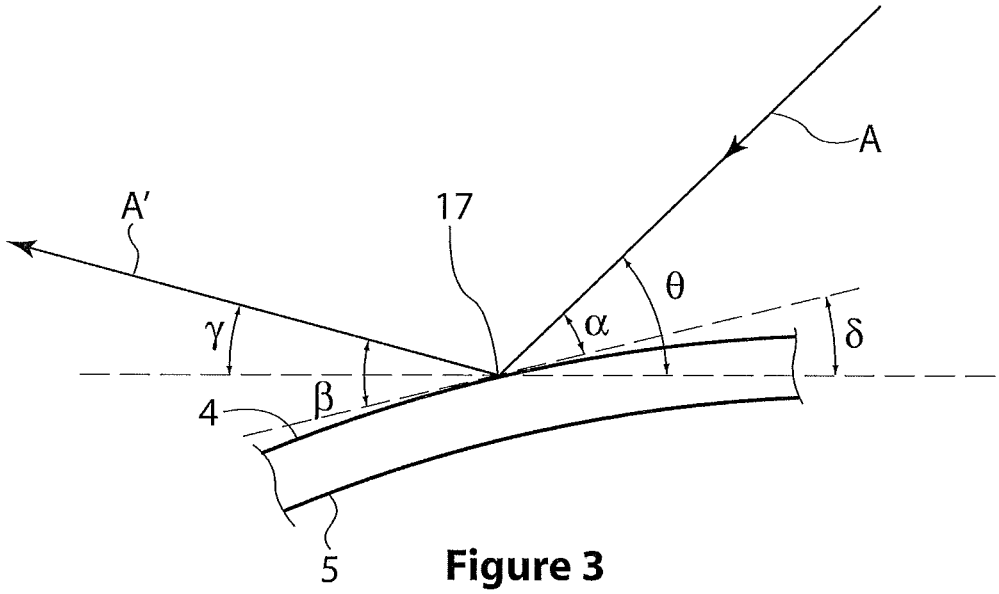
FIG. 3 is an enlarged side elevation view of a portion of the blind slat of FIG. 1 depicting light reflection therefrom.

The manner in which light is reflected from the upper surface 4 is depicted in greater detail in FIG. 3, depicting a light ray A impacting the upper surface 4 at an impact point 17. The upper surface 4 is inclined with respect to the horizontal (and thereby inclined with respect to the reference axis R) by a surface inclination angle $\delta$. The angle of incidence $\alpha$ of the solar ray A with respect to the upper face 4 is equal to the solar angle $\theta$ of the incoming solar ray A with respect to the horizontal, less the inclination angle $\delta$ (that is, $\alpha=\theta-\delta$). As noted above, the reflection ray A' has an angle of reflection $\beta$ that is equal to the angle of incidence $\alpha$. The reflection ray A' is inclined with respect to the horizontal by a projection angle $\gamma$. It can be readily shown that:

$$\gamma=\theta-2\delta$$

It is the projection angle $\gamma$ that determines the depth to which light is projected into a room bounded by the window adjacent to which the blind slats 1 are located. Diffuse light can effectively be provided to desk tops or other work surfaces located well away from the window by having the reflection ray impact the ceiling and re-reflect down from the ceiling down to the work surface. Generally, the greater the surface inclination $\delta$ of the upper face 4, the lower will be the projection angle $\gamma$, thus providing projection of light deeper into the room. Light will also project deeper into the room from blind slats located towards the bottom of the window, given that there is a greater distance between the blind slat 1 and the ceiling than from a blind slat 1 located towards the top of the window.

Referring back to FIG. 2, for a blind slat 1 positioned 2 metres from the ceiling, and solar angle $\theta$ of 45°, set out below are the projection distances from the blind slat 1, at which light will impact a work surface located at the same height of 2 metres from the ceiling for each of solar rays f-p.

Referring back to FIG. 2, for solar radiation reflecting from a blind slat 1, with a solar angle $\theta$ of 45°, it can be seen that reflection rays a' through e' have a high projection angle $\gamma$ such that they impact on the underside of the next lowermost blind slat 1. Reflection rays f' through l' have projection angles $\gamma$ that are sufficiently small to allow the reflected rays to project a significant distance into the room, rebounding from the ceiling so as to provide diffuse lighting to work surfaces placed large distances, typically in excess of 4.5 m, from the blind slat 1. The reflection ray j' has the lowest projection angle $\gamma$ and, accordingly, projects light the greatest distance into the room. Reflection rays m' through p' have relatively high projection angles $\gamma$ and, accordingly, are reflected from the ceiling a relatively short distance into the room and thus only provide reflected light on work surfaces located nearby the window that is covered by the blind slats 1. It can be seen that all of the reflection rays f' through l' that project light deeply into the room reflect light from the mid-region 16 of the upper surface of the blind slat 1.

The projection distances will be reduced for blind slats that are located closer to the ceiling and the projected distances will, of course, vary dependent upon the solar angle $\theta$. The blind slats 1 may, however, be controlled by any of various known manners to tilt to follow the sun, thereby optimising the projection distance for various solar angles $\theta$.

Portions of the blind slat falling outside of the mid-region 16, primarily being those regions of the upper surface 4 that are inclined towards the leading end 2, do not project rays as deeply into the room as do those that are inclined towards the trailing end 3, being those portions of the upper surface 4 located within the mid-region, as will be apparent from the analysis above. As noted above, these results can be optimised by tilting the blind slats to achieve the optimised projection of light. Whilst, for the purposes of optimising light projection, it would be preferred to minimise the size of those regions to of the upper surface 4 that are inclined towards the leading end 2, the basic profile configuration incorporating these regions in the convex/concave profile to enhance the structural rigidity of the slats, and particularly their performance under wind load.

Figure 4:
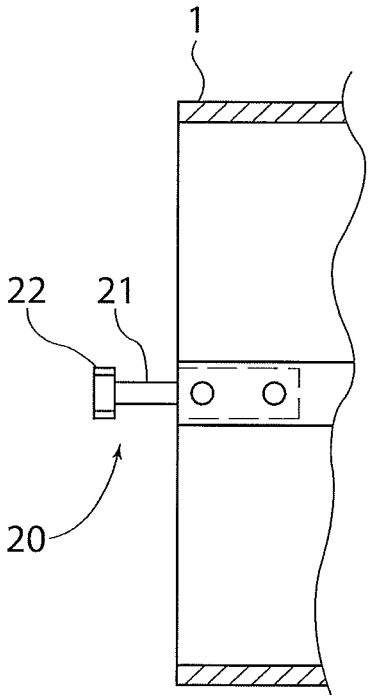
FIG. 4 is a fragmentary plan view of one end of the blind slat of FIG. 1.

Referring now to FIGS. 4 through 6, the manner in which the blind slats 1 are supported to form a blind assembly and controlled will now be described. Firstly, referring to FIG. 4, a guide pin 20 in the form of an elongate shaft 21 and enlarged head 22 is mounted at the centre of each opposing end of each blind slat 1. The guide pins 20 are captively retained within a vertical channel mounted on the building structure immediately adjacent each lateral end of the window. The channel acts to guide the blind slats 1 to move in a vertical direction only, restraining the blind slats against wind loads and the like.

Referring to FIGS. 5 and 6, a lift cord 23 extends through an aperture 18 provided in the centre of the profile of each blind slat 1. The lift cord 23 is secured to the lowermost blind slat 1 such that retraction of the lift cord 23 elevates the blind slats 1 into a stacked configuration as depicted in FIG. 6, at the top of the window. There will typically be at least two lift cords 23 spaced along the length of the blind slats 1.

Tilt control of the blind slats 1 is by way of leading and trailing tilt tapes 24, 25 located adjacent the leading end 2 and trailing end 3 of the blind slats 1 respectively. The leading tilt tape 24 is secured to the leading end 2 of each blind slat 1 by way of a clip 26 pivotally mounted within the cylindrical cavity 12 defined by the leading rolled portion 11 of each blind slat 1. The clip 26 is pivotally coupled to a mounting element 27 fixed to the leading control tape 24. In the embodiment depicted, the mounting elements 27 are spaced along the leading control tape 24 by a distance of 107 mm, thereby defining the space between adjacent blind slats 1 when the blind assembly is in the lowered position. The trailing control tape 25 is similarly coupled to the trailing end 3 of each blind slat 1 by way of clips 26 that are pivotally mounted within the cylindrical cavity 14 defined by the trailing rolled portion 13 of each blind slat 1 and mounting elements 27 similarly fixed to the trailing control tape 25. There are typically at least two leading and trailing control tapes 24, 25 spaced along the length of the blind slats 1. Relative vertical displacement between the leading and trailing control tapes 24, 25 adjust the angle between the reference axis R of each blind slat 1 and the horizontal in the usual manner. The blind slats 1 are controlled between a horizontal configuration, (depicted in FIG. 6) and an inclined orientation (depicted in FIG. 5) at which the reference axis R is inclined to the horizontal by approximately 84 degrees. In the inclined orientation the blind slats 1 are closed, substantially preventing the entry of light into the room bounded by the window to which the blind assembly is fixed. The blind slats 1 may be oriented at any angle between the horizontal and closed position. The blind slats 1 may also be inclined in an opposing direction, with the reference axis R inclined to the horizontal by approximately −60° (with the leading end 2 located above the trailing end 3). The total range of angular movement of each blind 1 is thus approximately 144°.

A noise abatement buffer (not depicted) is secured to the leading rolled portion 11 of each blind 1 and engages the apex of the secondary convex portion 15 of the adjacent blind 1 when in the closed position as depicted in FIG. 3. The buffer prevents metal-on-metal contact and associated vibration, between adjacent blinds 1.

The invention claimed is:

1. A blind slat having a substantially constant cross-sectional profile extending between a leading end and a trailing end, said profile defining an upper face of said slat and a lower face of said slat, said upper face having:

a convex portion extending from adjacent said leading end towards said trailing end, said convex portion having an apex at which a tangent to said upper face is parallel to a reference axis of said profile extending laterally between said leading end and said trailing end;

a concave portion located between said convex portion and said trailing end, said concave portion having a base at which a tangent to said upper face is parallel to said reference axis;

an inflection forming a straight portion joining said convex portion and said concave portion, said upper face being inclined with respect to said reference axis by at least 11 degrees at said inflection; and a secondary convex portion defined between said concave portion and said trailing end;

wherein said profile further defines:

a leading rolled portion located extending between said convex portion and said leading end, said lower face, at said leading rolled portion, defining a substantially cylindrical cavity for receipt of a leading tape clip; and a trailing rolled portion located extending between said secondary convex portion and said trailing end, said lower face, at said trailing rolled portion, defining a further substantially cylindrical cavity for receipt of a trailing tape clip; and wherein said profile has a depth measured between said leading end and said trailing end of between 105 and 150 mm.

2. The blind slat of claim 1, wherein said base is offset laterally from said apex by at least 43 mm.

3. The blind slat of claim 1, wherein said convex portion has a substantially constant radius of between 50 and 65 mm.

4. The blind slat of claim 1, wherein said concave portion has a substantially constant radius of between 34 and 42 mm.

5. The blind slat of claim 1, wherein said upper face is inclined with respect to said reference axis by at least 20 degrees.

6. The blind slat of claim 1, wherein said base is offset laterally from said apex by about 49 mm and said depth is about 120 mm.

* * * * *